US005079830A

United States Patent [19]

Kobale et al.

[11] Patent Number: 5,079,830

[45] Date of Patent: Jan. 14, 1992

[54] METHOD OF MANUFACTURING AND ASSEMBLING A TWT DELAY LINE

[75] Inventors: Manfred Kobale, Faistenhaar; Peter Mammach, Unterhaching; Eckart Schmid, Poing, all of Fed. Rep. of Germany

[73] Assignee: Siemens Aktiengesellschaft, Munich, Fed. Rep. of Germany

[21] Appl. No.: 366,446

[22] Filed: Jun. 15, 1989

[30] Foreign Application Priority Data

Jun. 21, 1988 [DE] Fed. Rep. of Germany ..... 3820919

[51] Int. Cl.[5] ..... H01J 9/00; H01J 23/24

[52] U.S. Cl. ..... 29/600; 29/602.1; 315/3.5; 315/5.35

[58] Field of Search ..... 315/3.5, 3.6, 5.34, 315/5.35, 39.3, 39 TW; 29/600, 601, 602.1

[56] References Cited

U.S. PATENT DOCUMENTS

| | | | |
|---|---|---|---|
| 3,142,777 | 7/1964 | Sullivan | 315/39.3 X |
| 3,387,168 | 6/1968 | Beaver | 315/3.5 |
| 3,433,999 | 3/1969 | Espinosa | 315/3.5 |
| 4,035,687 | 7/1977 | Gross | 315/3.6 X |
| 4,542,581 | 9/1986 | Wolfram | 29/600 |
| 4,598,465 | 7/1986 | Cooper et al. | 315/3.5 X |
| 4,765,036 | 8/1988 | Harper et al. | 315/3.5 X |
| 4,947,467 | 8/1990 | Manoly et al. | 315/3.5 |

FOREIGN PATENT DOCUMENTS

| | | | |
|---|---|---|---|
| 1243786 | 7/1967 | Fed. Rep. of Germany | 315/39.3 |

*Primary Examiner*—Eugene R. LaRoche
*Assistant Examiner*—Benny T. Lee
*Attorney, Agent, or Firm*—Hill, Van Santen, Steadman & Simpson

[57] ABSTRACT

A delay line for travelling wave tubes, particularly travelling wave tube whose gain and whose output power are independent of frequency over a plurality of octaves and contain a helix (9) in an electrically conductive cylinder (5). The helix is fixed and adjusted by retaining rods (8). Loading webs (4) are arranged parallel to the axis of the adjoining electrically conductive cylinder (5) and a small gap (12) is left free adjacent the helix (9). The extremely high requirement for mechanical dimensional accuracy and reproducibility of the dimensions in such delay lines are obtained by using loading webs (4) which are integrally formed in the electrically conductive cylinder (5).

3 Claims, 3 Drawing Sheets

METHOD OF MANUFACTURING AND ASSEMBLING A TWT DELAY LINE

BACKGROUND OF THE INVENTION

1. Field of the Invention

This invention relates in general to a delay line for a broadband travelling wave tube which contains spacers and pole shoes which are coaxially arranged relative to an electrically conductive cylinder which contains a helix mounted in the metal cylinder and is fixed in coaxial alignment relative to the metal cylinder by retaining rods and which contains loading rods arranged parallel to the axis of the cylinder and wherein the loading rods or webs are formed in one piece to the inside walls of the electrically conductive cylinder.

2. Description of Related Art

See U.S. Pat. No. 3,397,339, International application WO 80/00049, European 0 121 465 which corresponds to U.S. Pat. No. 4,572,985, French Patent Publication 2 545 645, German DE 32 17 077, French 1,391,842 which corresponds to U.S. Pat. No. 3,203,477 and the publication entitled "Effective Use Of Dispersion Shaping and Broadband Helix TWT Circuits" by Putz and Cascone in I.E.D.M. 1979, Pages 422–424 and the publication entitled "Control of Phase and Gain Deviations In An Octave Bandwidth EHF TWT" by Handy and Puri, IEEDM 1986, Pages 508–511.

A travelling wave tube is described in the article referred to above by Putz and Cascone.

Extremely high demands are made of the dimensional accuracy of the loading webs and of the helix in a travelling wave tube. The spacing distance between the helix and the load webs must be in the range of a few tenths of a millimeter and must be accurate within a few millimeters over a length of, for example, ten centimeters.

SUMMARY OF THE INVENTION

It is an object of the present invention to provide a structure which can be manufactured with high precision and reproducibility. This object is achieved by providing a delay line for a broadband travelling field tube which contains spacers and pole shoes which are coaxially arranged on a electrically conductive cylinder which contains a helix mounted in the metal cylinder and which is fixed in coaxial alignment relative to the metal cylinder by using retaining rods. Loading rods are arranged parallel to the axis of the cylinder and extend up to the proximity of the helix, but a gap is provided between the end of the loading rods and the helix and the loading webs are formed as integral pieces with the inside wall of the electrically conductive cylinder.

The loading webs which are formed integrally as one piece with the inside wall of the electrically conductive cylinder according to the invention are optimally positioned and avoid fluctuations in tolerances which are unavoidable using soldering and other bonding processes of bonding and soldering two parts together. It is unavoidable when soldering or gluing spacers and pole shoes and delay lines and loading webs to prevent an inclination of the axis of such structure to the cylinder. The present invention by integrally forming the loading webs with the cylinder eliminates these problems. Focusing magnets are inserted between the pole shoes and the mutual positions of the various parts in the invention is not influenced by soldering or gluing as in the prior art.

In a simple manner, a vacuum tight structure results in that the spacers and magnetizable pole shoes which are mounted between them are soldered to each other and are formed with axial bores which exactly match the outside diameter of the electrically conductive cylinder. The metal cylinder is inserted into the bores of these parts and is then soldered to the spacers which serve to center the focusing magnets and is also soldered to the pole shoes.

An advantageous method for the manufacturing of the delay line of the invention comprising the following method steps wherein the sequence of the method steps is to be noted but individual method steps can incur in a different sequence. These steps are:

a) mounting spacers and pole shoes on each other in an alternating sequence and soldering them together and the spacers and pole shoes being provided with axial openings.

b) the coaxial openings are aligned with the outside diameter of a metal cylinder so that it can be inserted and soldered to these members. The metal cylinder is selected to be thick walled and electrically conductive and have an inside diameter which is at least no larger than the smallest mutual radial distance between the loading webs and which has an outside diameter which corresponds to that of the electrically conductive cylinder which is inserted into the coaxial bores of the spacers and pole shoes and which is soldered therein. The loading webs are formed out of the inside wall of the electrically conductive tube using a spark erosion method after which the retaining rods and the helix are inserted and fixed in position.

Three retaining rods can advantageously be provided and one of the retaining rods can be supported against the inside wall of the electrically conductive cylinder with a spring.

It is known that extremely high precision which is required in forming loading webs and the cylinder can be obtained using spark erosion methods. The above listed sequence and method steps allows a completely warp-free forming of the desired profile and an exact adjustment of the beam relative to the magnets. The spark erosion formation of the webs also allows the manufacture of complicated configurations of loading webs. The sequence of first integration of the tube and then formation of the loading webs by spark erosion also allows the insulating rods to be introduced with a relatively high pressing force which is achieved by relatively hard springing since the wall of the cylinder is strengthened and reinforced by the spacers and pole shoes after the integration with the cylinder and it can thus withstand a high pressure on the inside wall of the cylinder. This assures an especially pronounced advantageous removal of the heat from the helix. The retaining rods can be selected from one of the following substances BN, BeO, or $Al_2O_3$. The good thermal conductivity of the retaining rods can also be obtained using diamond material for extremely high loads to result in an advantageous structure.

The method of manufacturing the invention also allows high reproducibility since the influence of the soldering process does not effect the ultimate form of the device since the ultimate form is not produced until after the soldering.

Precision of ±5 um over a length of a 100 mm can be obtained and reproduced as many times as desirable in this manner without particular difficulties even when the inside diameter of the tube which is introduced is only about 2 mm.

In addition to the described method of forming the structure, the holding of the helix can also be accomplished with known methods such as for example by shrinking or soldering.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
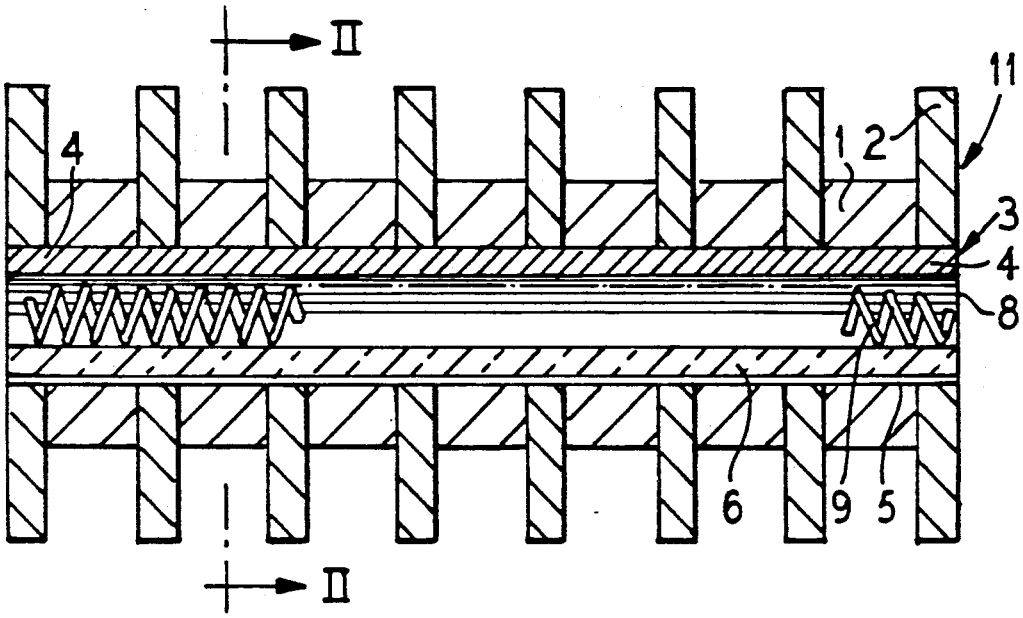
FIG. 1 is a sectional view through a delay line of the invention in which the diameter dimensions have been greatly magnified.
Figure 2:
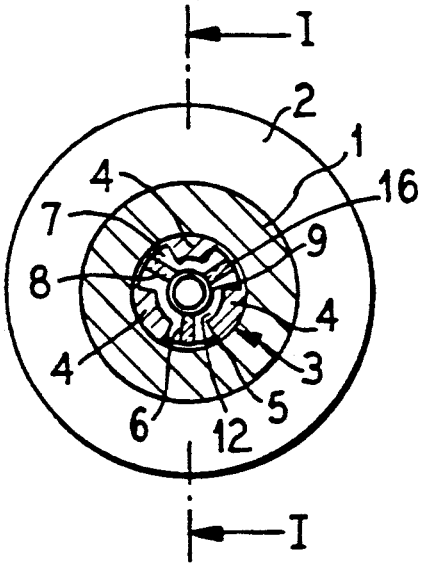
FIG. 2 is a sectional view taken on line II—II of FIG. 1.

As shown in FIGS. 1 and 2, a tubular member comprises a plurality of ring-shaped non-magnetic spacers 1 and pole shoes 2 which are formed of magnetizable material. The pole shoes 2 have a larger radius and project beyond the spacers 1 in the radial direction and focusing magnets can be mounted between two respective neighboring pole shoes in a simple manner. The assembly of such tube member expediently occurs by placing the spacers 1 and the pole shoes 2 onto a tube 3 and by subsequently soldering the individual spacers and pole shoes.

The inside diameter of the tube member 11 is such that it is the same as the outside diameter of a cylinder 5. The cylinder 5 is attached in the tube member 11, for example by soldering. Loading webs 4 are integrally formed with the cylinder 5 so that the loading webs 4 and the cylinder 5 are formed from a single piece. The loading webs 4 are arranged so that a gap or space 12 (see FIG. 2) which has a precisely defined width relative to a coaxially arranged helix 9 exists. The helix 9 is supported and fixed by a plurality of retaining rods 6, 8 and 16 which are equally angular spaced within the opening of the cylinder 5 and have ends which terminate so as to support the helix. The rods 6 and 16 may have their ends in intimate contact with the inside wall of the cylinder 5 and the rod 8 may be somewhat shorter in the radial distance so that a tension spring 7 can be mounted between the cylinder wall of the cylinder 5 and the outer surface of the rod 8.

Heat transmission characteristics between the helix 9 and the retaining rods 6, 8 and 16 and between the retaining rods 6 and 16 and the cylinder 5 and between the retaining rod 8 and the tension spring 7 result due to the pressure between these members. An optimum degree of precision for the position of the helix 9 simultaneously results since the retaining rods are ground to dimensions with extreme precision (See FIG. 2).

When increased demands are required for the elimination of heat, three or more retaining rods can be utilized and it may be desired to solder such retaining rods to the cylinder 5.

A method of manufacturing such a delay line, is that first the tube member 11 is constructed from the spacers 1 and the pole shoes 2 and the inside wall of the center opening is brought to the required dimension by honing. Then a thick walled tube 3 is inserted into the tube member 11 and is fixed therein as, for example, by soldering. Then the desired profile is formed in the inner diameter of the thick walled tube 3 so as to form the loading webs 4 therein. The loading webs are formed by a spark erosion method wherein a wire is drawn through the tube and an electrical spark is generated so as to cut the material from the inside of tube 3 to form the webs 4. The cutting wire and spark is simultaneously moved in a plane perpendicular to the axis of the tube to form the desired contours of the webs 4 out of the walls of the tube. Loading webs 4 which have different arbitrary cross-sections can be formed with this method. The end faces of the loading webs and the inside wall of the cylinder are thus produced with the same tool during the same method step so that maximum precision of the mutual positioning of the parts are achieved over their entire lengths. Accordingly, an optimum degree of precision of positioning the helix 9 relative to the inside walls of the cylinder 5 by way of the retaining rods 6, 16 and 8 is also achieved. By honing the inside opening of the tube member 11 promotes surface wide moistening and uniform distribution of solder during the soldering step.

In an advantageous practice of the method of the invention, the spacers 1 and the pole shoes 2 are placed onto a thick wall nonmagnetic tube 3 and these elements are soldered to each other in one work step. Subsequently, the loading webs 4 and the cylinder 5 are formed out of the thick walled tube 3 by spark erosion and then the retaining rods 6, 16 and 8 and the tension springs 7 are inserted as shown in FIG. 2. This embodiment of the method of the invention is relatively inexpensive and delay lines for broadband travelling wave tubes can be manufactured with high precision. The focusing magnets which are required for the travelling wave tube can be inserted between the pole shoes 2 and can be adjusted to optimum magnetic field distribution in the cylinder 5 and the magnets can then be glued and soldered to the pole shoes. This produces no disturbing influences on the geometry of the delay line.

Since there are no solder joints or glued joints whatsoever to effect the tolerance of the mutual position of the helix, the cylinder wall and the loading webs and the structure of the invention using the disclosed method, there is no risk of modifying the mutual positions in the radial direction between these parts during assembly and such modification is impossible. The apparatus and method therefore assures that a tolerance of, for example, only ±5 um can be reproducibly obtained over a length of 10 cm in mass production.

Figure 3:
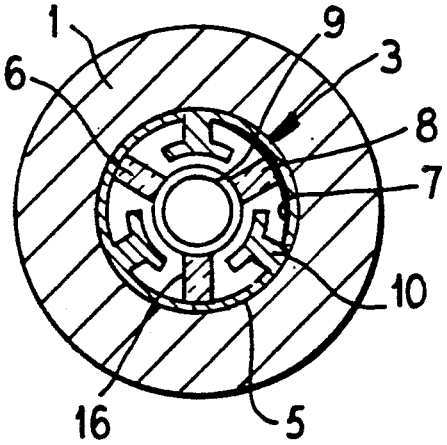
FIG. 3 is a sectional view illustrating a modified form of the delay line.

The structure of the invention also allows the employment of complicated shapes for the loading webs as shown, for example, by the end view of the loading webs 10 in FIG. 3. Such web-shapes can also be manufactured with high precision and are reproducible when according to the invention the tube 3 is previously introduced into the tube member 11 and is fixed therein.

The described structures can be produced with the invention for example, with a tube 3 which has an outside diameter of less than 2 mm.

So as to obtain especially low thermal resistance between the retaining rods and the cylinder wall, the retaining rods which have equal radial dimensions can be fixed to the cylinder 5 using a shrinking technology. This is accomplished in that before the introduction of the helix and the retaining rods 6, a difference in temperature is produced so that the tube member 11 and the cylinder 5 are hotter than the helix 9 and the retaining rod 6. After introduction of the helix 9 and the retaining rod 6, the temperature difference disappears and the helix will be placed under pressure and thus held due to the heat shrinkage. Such mounting technique results in no positional deviations such as would occur if soldering were used. On the other hand, for example, the combination of the shrink technique with an additional soldering step allows the mechanical fixing to be accomplished by the shrink process and the solder merely additionally promotes transmission of heat.

The cylinder 5 may be made of copper or metal which has a high specific electrical resistance. The retaining rods 6, 16 and 8 may be made of ceramic with relatively low requirements and diamond material is desirable with higher requirements when higher requirements for heat elimination exist since this material has a considerably higher thermal conductivity than other suitable materials.

Figure 4:
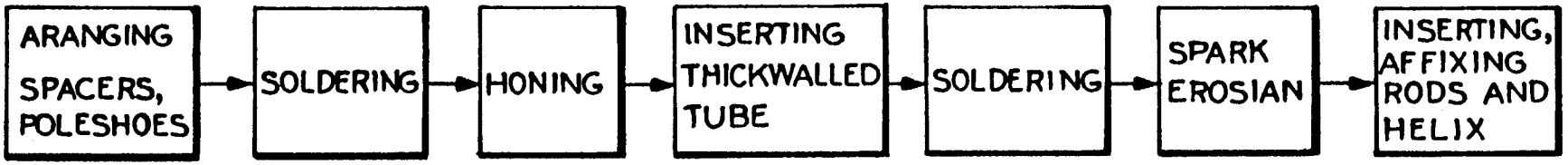
FIGS. 4 and 5 show the claimed methods schematically.

FIG. 4 illustrates the method which shows that the spacer pole shoes are arranged and than soldered and then honed. Then the thick walled tube is inserted and soldering occurs. Then insert the spark erosion is accomplished after which the rods and the helix are inserted.

Figure 5:
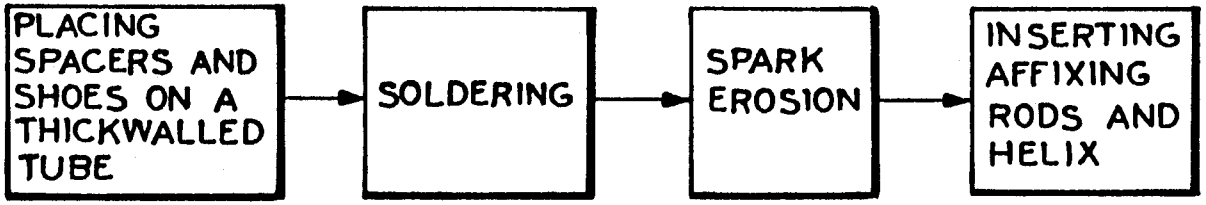

FIG. 5 illustrates the method wherein spacers and shoes are placed on a thick-walled tube after which soldering occurs and then spark erosion after which inserting and affixing rods and helix occurs.

Figure 6:
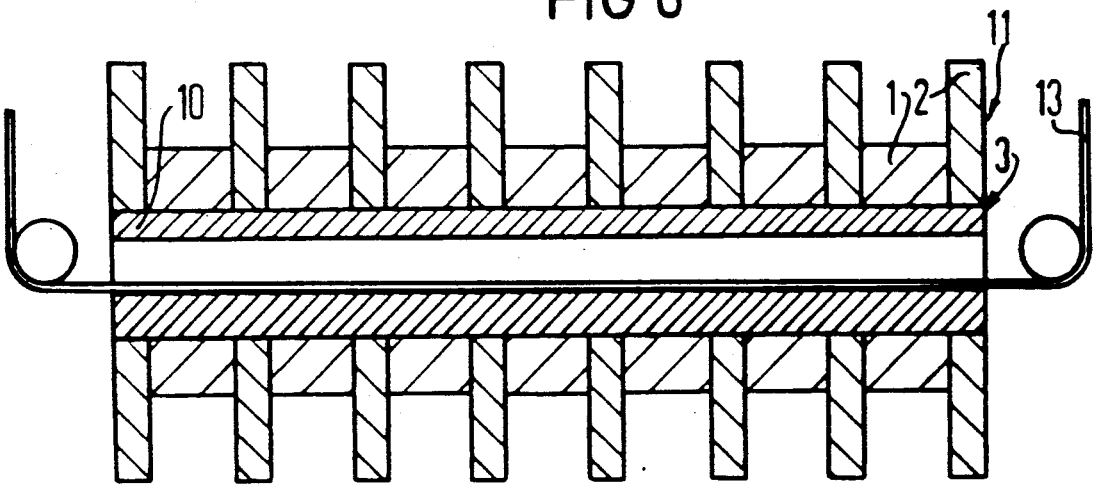
FIG. 6 is a sectional view illustrating the spark erosion method.

FIG. 6 is a sectional view through the tube member 11 and the tube 3 and illustrates a wire 13 which is inserted through the central opening of the tube 3 and wherein an electrical spark is generated between the wire 13 and the inner surface of the tube 3 so as to cut and form the loading webs 4 such as illustrated in FIG. 2 or the loading webs 10 as illustrated in FIG. 3. Support members 16 and 17 support opposite ends of the wire 13 on opposite ends of the tube 3 and the wire 13 can be moved relative to the tube so as to provide the proper shape for the loading webs 4 in FIG. 2 or the loading webs 10 in FIG. 3.

Although the invention has been described with respect to preferred embodiments, it is not to be so limited as changes and modifications can be made which are within the full intended scope of the invention as defined by the appended claims.

We claim as our invention:

1. A method for manufacturing a delay line in which loading webs are formed comprising the steps of, a) soldering together alternately arranged circular spacers and circular pole shoes each of which have central circular openings, b) inserting a thick-walled electrically conductive round metal tube which has an inside wall and an outside wall into the central circular openings of said spacers and pole shoes, c) soldering said outside wall of the thick-walled electrically round conductive tube to said spacers and pole shoes, d) forming by spark erosion said loading webs from the inside wall of said electrically conductive tube, e) inserting retaining rods and a helix into said tube and affixing said rods and said helix to said inside wall, and f) heat shrinking said tube to make a tight assembly of said retaining rods and said helix.

2. A method according to claim 1 further comprising honing the central openings in the spacers and pole shoes before inserting said conductive tube.

3. A method of claim 1 wherein said spark erosion is accomplished with a wire which is drawn through said tube and an electrical spark is generated between said wire and said tube.

* * * * *